US005336468A

United States Patent [19]

Tezuka et al.

[11] Patent Number: 5,336,468

[45] Date of Patent: Aug. 9, 1994

[54] PIPETTE TIP

[75] Inventors: Sigeru Tezuka; Masao Kitajima, both of Saitama; Nobuyyki Kita, Shizuoka, all of Japan

[73] Assignee: Fuji Photo Film Co., Ltd., Kanagawa, Japan

[21] Appl. No.: 597,889

[22] Filed: Oct. 15, 1990

[30] Foreign Application Priority Data

Oct. 16, 1989 [JP] Japan ..... 1-268582

[51] Int. Cl.[5] ..... B01L 3/00

[52] U.S. Cl. ..... 422/100; 73/863.32; 73/864.22; 73/864.24

[58] Field of Search ..... 422/100; 73/864.22, 73/864.24, 863.32; 435/39; 427/284, 430.1

[56] References Cited

U.S. PATENT DOCUMENTS

| | | | |
|---|---|---|---|
| 4,121,466 | 10/1978 | Reichler et al. | 73/864.22 |
| 4,459,267 | 7/1984 | Bunce et al. | 422/100 |
| 4,586,546 | 5/1986 | Mezei et al. | 73/864.24 |
| 4,587,213 | 5/1986 | Malecki | 435/39 |
| 4,625,677 | 12/1986 | Neher | 118/66 |

FOREIGN PATENT DOCUMENTS

| | | | |
|---|---|---|---|
| 3811492 | 10/1989 | Fed. Rep. of Germany | 427/284 |
| 2207763 | 6/1974 | France . | |
| 250661 | 10/1987 | German Democratic Rep. . | |

OTHER PUBLICATIONS

Derwent Abstract No. 88-296023, JP-A-63-215 771 (Asahi Glass K.K.) Aug. 9, 1988.

Derwent Abstract No. 85-009387, JP-A-59-207 855 (Toyota Cent. Res. & Dev.) Nov. 26, 1984.

*Primary Examiner*—Jill A. Johnston

*Assistant Examiner*—Laura E. Collins

*Attorney, Agent, or Firm*—McAulay Fisher Nissen Goldberg & Kiel

[57] ABSTRACT

A pipette tip is obtained from molding of a plastic material. At least part of the outer surface of the pipette tip has been treated with a water repellent material. The pipette tip is suitable for applying a predetermined amount of a liquid sample during chemical analyses, particularly for applying a measured amount of a liquid having a small surface tension and a high viscosity.

2 Claims, 1 Drawing Sheet

PIPETTE TIP

BACKGROUND OF THE INVENTION

1. Field of the Invention

This invention relates to a pipette tip, which is obtained from molding of a plastic material and which is suitable for applying a predetermined amount of a liquid sample during chemical analyses. This invention particularly relates to a pipette tip, which is obtained from molding of a plastic material and which is suitable for applying a predetermined amount of an aqueous solution having a small surface tension and a high viscosity, particularly for applying a predetermined amount of a body fluid during clinical assays.

2. Description of the Prior Art

Recently, dry type clinical and chemical assays are carried out widely for easy and quick analyses. With the dry type clinical and chemical assays, droplets of liquid samples are independently applied to chemical analysis slides containing reagents which will react with specific constituents, such as glucose and urea nitrogen, in the liquid samples, such as blood. Changes in color, which are caused to occur by the reactions between the reagents and the specific constituents, are colorimetrically analyzed, and the amounts of the specific constituents in the liquid samples are thereby determined.

A droplet of a liquid sample has heretofore been applied to a chemical analysis slide with operations wherein a predetermined amount of the liquid sample is taken up into a pipette, a round droplet of the liquid sample is formed at the leading edge of the pipette, and the droplet is carefully applied to the center part of the chemical analysis slide.

During the analyses, in general, pipette tips formed of a plastic material are used. By way of example, a measured amount of a liquid sample falling within the range of 10 μl to 120 μl is taken up into a pipette tip, and a predetermined amount of the liquid sample falling within the range of several micro-liters to 100 μl is fed out of the pipette tip. At this time, if the outer circumferential surface of the pipette tip is wet, part of the liquid sample will shift to the outer circumferential surface of the pipette tip. Such liquid shifting phenomenon will cause errors to occur in the results of analyses.

Disposable type pipette tips formed of plastic materials have heretofore been used widely in the physicochemical, medical, and biological fields. In most cases, aqueous solutions are processed with the disposable type pipette tips. The disposable type pipette tips are formed of plastic materials having good water repellency, such as polypropylene, polystyrene, and polyethylene. Therefore, when the disposable type pipette tip is used to process an ordinary aqueous solution, little solution will adhere to the outer circumferential surface of the pipette tip. However, if it occurs that a liquid remains on the outer circumferential surface of the pipette tip, during the feeding of a liquid sample out of the pipette tip, the liquid sample will be dragged to the outer circumferential surface of the pipette tip and will shift thereto.

The extent of adhesion of a liquid sample to the outer circumferential surface of a pipette tip and the extent of the liquid shifting to the outer circumferential surface depend largely on the surface tension and the viscosity of the liquid sample and the physical properties of the surface of the pipette tip.

For example, in cases where a polypropylene pipette tip is used which is designed to feed out a measured amount of a liquid sample falling within the range of 10 μl to 100 μl little liquid shifting phenomenon occurs with pure water, physiological saline, or the like.

However, blood plasma and blood serum, which are processed during clinical assays, have a high viscosity falling within the range of 1.5 to 2.5 cP. Therefore, the liquid shifting phenomenon easily occurs with such liquid samples. Also, whole blood samples have a viscosity as high as 10 cP to several tens of centipoises, and the liquid shifting phenomenon very easily occurs with such liquid samples.

FIG. 3A is an explanatory view showing how a droplet of a liquid sample is formed at the leading edge of a conventional pipette tip during the feeding of the liquid sample out of the pipette tip after the outer circumferential surface of the edge part of the pipette tip has been wiped with tissue paper, or the like. FIGS. 3B and 3C are explanatory views showing how a droplet of a liquid sample is formed at the leading edge of a conventional pipette tip during the feeding of the liquid sample out of the pipette tip without the outer circumferential surface of the edge part of the pipette tip being wiped. In FIGS. 3A, 3B, and 3C, reference numeral 1 indicates the edge part of the pipette tip, and reference numeral 2 indicates the leading edge of the pipette tip. Reference numeral 3 indicates the droplet of the liquid sample, and reference numeral 4 indicates the top layer of an analysis medium to which the liquid sample is to be applied.

As illustrated in FIG. 3A, when a liquid sample, which has been taken up into a pipette tip, is fed out, a spherical droplet should be formed under the leading edge of the pipette tip. In such cases, the sizes of the droplets become constant. Therefore, the liquid sample can be fed out reliably when the distance between the leading edge of the pipette tip and the sample receiving surface (for example, the surface of a liquid contained in a vessel, the surface of a wall of a device, such as a glass device, or the surface of spreading layer of a chemical analysis slide) is kept constant.

However, as illustrated in FIGS. 3B and 3C, if the liquid shifting phenomenon occurs, the droplet formed during the feeding of the liquid sample shifts upwardly. In such cases, the distance between the leading edge of the pipette tip and the bottom of the droplet thus formed becomes markedly smaller than the correct distance. Therefore, the droplet cannot reach the sample receiving surface, and cannot be applied thereto.

In cases where the liquid sample is applied manually, the position and the angle of the leading edge of the pipette tip can be found visually and can be adjusted in accordance with how the liquid sample is fed out. Therefore, the adverse effects of the liquid shifting of part of the liquid sample and the upward shifting of the droplet of the liquid sample can be eliminated. However, in cases where the liquid sample is applied automatically, the relationship between the position of the sample receiving surface and the position of the leading edge of the pipette tip is fixed. Therefore, if the upward shifting of the droplet of the liquid sample occurs, no liquid sample can be applied to the sample receiving surface.

Particularly, in the dry chemistry field, in order for a high analysis accuracy to be obtained, a droplet of a liquid sample must be formed as slowly as possible at the leading edge of a pipette tip. Thereafter, the droplet must be carefully applied to the surface of a chemical analysis slide. In such cases, serious problems will occur if the droplet of the liquid sample shifts upwardly.

In order to eliminate the problems described above, a method has been proposed wherein a surface sensor is used to detect the position of the sample receiving surface or a sensor is used to detect whether a normal droplet is or is not formed at the leading edge of a pipette tip.

Also, various attempts have heretofore been made to select the material and the shape of a pipette tip such that an aqueous solution sample may remove smoothly from the pipette tip, thereby to obtain a high accuracy of quantitative determination.

For example, a method has been proposed wherein a pipette tip is constituted of polypropylene, a silicone resin, or a fluorine resin. A method has also been proposed wherein only the leading edge of a pipette tip is made thin and short such that a droplet of a liquid sample does not easily shift upwardly. However, none of the proposed methods is suitable or satisfactory from the viewpoint of simplicity and the cost of the apparatus, and the effect on the prevention of the upward shifting phenomenon of a droplet of a liquid sample, particularly whole blood or blood plasma.

A liquid adhering to the edge part of a pipette tip may be wiped off each time a liquid sample is taken up into the pipette tip. With this method, the adverse effects of the liquid shifting phenomenon and the upward shifting phenomenon can be minimized. However, considerable time and labor are required to wipe the edge parts of pipette tips, and wiping failures will often occur. Also, even if an operator who carries out the wiping operation wear gloves during the wiping operation, there is the risk that he touches a blood sample, or the like, and is infected with a virus of hepatitis, or the like. Problems also occurs with regard to the discarding of wiping materials.

SUMMARY OF THE INVENTION

The primary object of the present invention is to provide a pipette tip of a measuring pipette, which pipette tip is suitable for applying a predetermined amount of a liquid sample during chemical analyses.

Another object of the present invention is to provide a pipette tip of a measuring pipette, which pipette tip is suitable for applying a measured amount of a liquid having a small surface tension and a high viscosity.

The specific object of the present invention is to provide a disposable type pipette tip which is constituted of a plastic material and which is suitable for applying a predetermined amount of a liquid sample during chemical analyses.

The present invention provides a pipette tip obtained from molding of a plastic material, wherein at least part of the outer surface of the pipette tip has been treated with a water repellent material.

As will be described in detail later, the pipette tip in accordance with the present invention is suitable for applying a predetermined amount of a liquid sample during chemical analyses. Also, the pipette tip in accordance with the present invention is suitable for applying a measured amount of a liquid having a small surface tension and a high viscosity.

A measured amount of a liquid sample may be manually taken up into a disposable type pipette tip. Alternatively, for this purpose, automatic operations may be employed wherein a pipette nozzle is moved automatically, and the disposable type pipette tip is fitted to and removed from the pipette nozzle in accordance with its movement. In both cases, with the disposable type pipette tip in accordance with the present invention, no wiping operation is required, and the accuracy, with which a measured amount of a liquid sample is taken up and fed out, can be kept high.

In cases where a conventional disposable type pipette tip is employed during the application of a measured amount of a liquid sample, the following steps are required:

1) Selecting a pipette.
2) Selecting a disposable type pipette tip.
3) Fitting the pipette tip to a pipette nozzle.
4) Taking up a liquid sample into the pipette tip.
5) Removing the excess liquid sample adhering to the outer surface of the pipette (with tissue paper, or the like).
6) Feeding the liquid sample from the pipette tip into a vessel or a to a sample receiving surface.
7) Removing the pipette tip from the pipette nozzle.
8) Discarding the removed pipette tip.

With the pipette tip in accordance with the present invention, the wiping operation described in (5) need not be carried out.

DETAILED DESCRIPTION OF THE INVENTION

Figure 1:
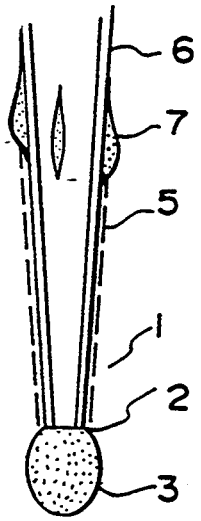
FIG. 1 is an explanatory view showing how a droplet of a liquid sample is formed at the leading edge of an embodiment of the pipette tip in accordance with the present invention during the feeding of the liquid sample out of the pipette tip.

FIG. 1 is an explanatory view showing how a droplet of a liquid sample is formed at the leading edge of an embodiment of the pipette tip in accordance with the present invention during the feeding of the liquid sample out of the pipette tip. In FIG. 1, reference numeral 1 indicates the edge part of the pipette tip, and reference numeral 2 indicates the leading edge of the pipette tip. Reference numeral 3 indicates the droplet of the liquid sample, and reference numeral 5 indicates a water repellent layer. Reference numeral 6 indicates an intermediate part of the pipette tip, and reference numeral 7 indicates the liquid sample adhering to part of the outer circumferential surface of the pipette tip.

As illustrated in FIG. 1, no liquid sample adheres to the outer circumferential surface of the edge part of the pipette tip in accordance with the present invention. Also, a droplet having a correct spherical shape is formed at the leading edge of the pipette tip.

Figure 2A:
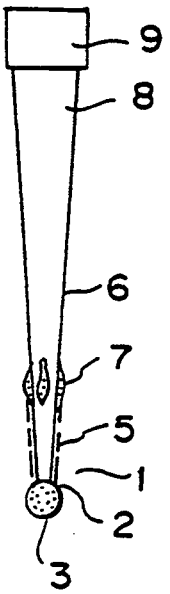
FIG. 2A is an explanatory view showing how a droplet of a liquid sample is formed at the leading edge of an embodiment of the pipette tip in accordance with the present invention during the feeding of the liquid sample out of the pipette tip, wherein only the outer circumferential surface of an edge part of the pipette tip has been treated with a water repellent material.
Figure 2B:
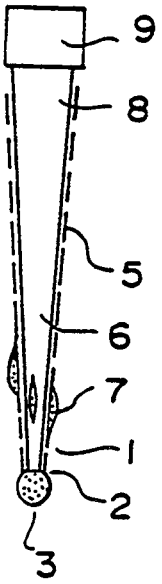
FIG. 2B is an explanatory view showing how a droplet of a liquid sample is formed at the leading edge of an embodiment of the pipette tip in accordance with the present invention during the feeding of the liquid sample out of the pipette tip, wherein the whole outer circumferential surface, i.e. the outer circumferential surface of an edge part, an intermediate part, and a base part, of the pipette tip has been treated with a water repellent material.
Figure 3A:
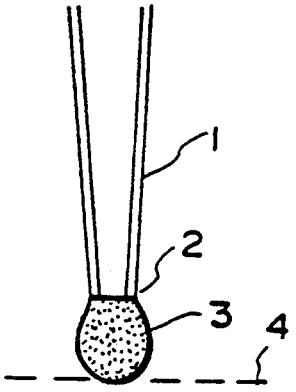
FIG.3A PRIOR ART
FIG. 3A is an explanatory view showing how a droplet of a liquid sample is formed at the leading edge of a conventional pipette tip during the feeding of the liquid sample out of the pipette tip after the outer circumferential surface of the edge part of the pipette tip has been wiped with tissue paper, or the like, and FIGS. 3B and 3C are explanatory views showing how a droplet of a liquid sample is formed at the leading edge of a conventional pipette tip during the feeding of the liquid sample out of the pipette tip without the outer circumferential surface of the edge part of the pipette tip being wiped.
Figure 3B:
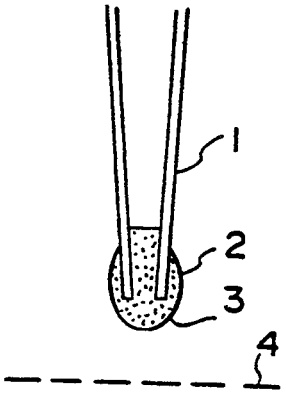
FIG.3B PRIOR ART
Figure 3C:
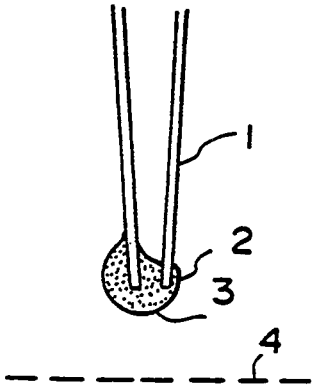
FIG.3C PRIOR ART

FIG. 2A is an explanatory view showing how a droplet of a liquid sample is formed at the leading edge of an embodiment of the pipette tip in accordance with the present invention during the feeding of the liquid sample out of the pipette tip, wherein only the outer circumferential surface of an edge part of the pipette tip has been treated with a water repellent material. FIG. 2B is an explanatory view showing how a droplet of a liquid sample is formed at the leading edge of an embodiment of the pipette tip in accordance with the present invention during the feeding of the liquid sample out of the pipette tip, wherein the whole outer circumferential surface, i.e. the outer circumferential surface of an edge part, an intermediate part, and a base part, of the pipette tip has been treated with a water repellent material. In FIGS. 2A and 2B, similar elements are numbered with the same reference numerals with respect to FIG. 1. Also, reference numeral 8 indicates the base part of the pipette tip, and reference numeral 9 indicates the part of the pipette tip, which part is fitted to a pipette nozzle.

With reference to FIG. 2A, the excess liquid sample 7 adhering to the untreated part of the pipette tip remains at the boundary between the treated part and the untreated part. The excess liquid sample 7 does not flow over the edge part 1 of the pipette tip, nor does it combine with the droplet 3 which is to be applied.

In the embodiment of FIG. 2B, there is the risk that the excess liquid sample 7 flows over the edge part 1 of the pipette tip and combines with the droplet 3.

For the sake of economy, the pipette tip in accordance with the present invention should be constituted of a plastic material.

During the formation of pipette tips from molding of a plastic material, silicone, or the like, is generally used as a releasing agent. However, as will be described in Examples later, pipette tips obtained with such a conventional method are markedly inferior to the pipette tip in accordance with the present invention with respect to the performance of preventing the liquid shifting phenomenon and upward shifting phenomenon.

Methods, with which edge parts of pipette tips are processed with a water repellent liquid immediately before the pipette tips are used, have been proposed in, for example, Japanese Patent Application Nos. 63(1988)-105688, 63(1988)-105687, 63(1988)-126548, and 63(1988)-151803. As the water repellent liquids, silicone oils, vegetable oils, animal oils, mineral oils, synthetic esters, and higher alcohols are proposed.

In the present invention, basically, the same substances as those proposed in the cited references may be employed as the water repellent material. However, as the water repellent material for the pipette tip in accordance with the present invention, a liquid silicone having a viscosity of not lower than 1,000 cP at 20° C., a silicone which is solid at room temperature, a curing type silicone, or a fluorine resin should preferably be employed. Among the water repellent materials enumerated above, the silicone, which is solid at room temperature, or the curing type silicone are more preferable.

In cases where a liquid silicone is employed, it should be selected from those having a viscosity of not lower than 1,000 cP at 20° C.

If a liquid silicone having a viscosity lower than 1,000 cP at 20 C. is used, when the pipette tip is immersed in a liquid sample, part of the liquid silicone will migrate to the liquid sample. Therefore, errors will occur in the results of analyses.

In order for the pipette tip to be treated with a liquid silicone, the pipette tip may be dipped in the liquid silicone. Alternatively, the liquid silicone may be coated on the outer surface of the pipette tip. As another alternative, the liquid silicone may be diluted with a solvent, the diluted silicone may be sprayed to the pipette tip, and then the solvent may be removed by evaporation.

In order for the pipette tip to be treated with a silicone, which is solid at room temperature, or a curing type silicone, which hardens after being applied to the pipette tip, the silicone may be dissolved in a solvent, and the resulting solution may be applied to the pipette tip with the dipping process, the coating process, or the spraying process.

The silicone, which is solid at room temperature, may be selected from the group consisting of polydialkylsiloxanes, such as polydimethylsiloxanes, and polymethylethylsiloxanes; polyarylsiloxanes, such as polydiphenylsiloxanes, and polymethylphenylsiloxanes; polyallylsiloxanes; and derivatives of these polysiloxanes.

As the curing type silicone, a silicone is used which is capable of forming a three-dimensional structure by a condensation reaction, such as deamination, deacetylation, dealcoholization, oxime removal, or dehydrogenation.

The solvent for the silicone, which is solid at room temperature, or the curing type silicone may be selected from the group consisting of petroleum solvents, such as n-hexane, cyclohexane, and toluene; mixtures of two or more of the petroleum solvents; ester solvents, such as methyl acetate, and ethyl acetate; propylene glycol monomethyl ether acetate; methanol; ethanol; methyl ethyl ketone; and water. The solvents enumerated above may be used alone or in combination.

The solution of the silicone, which is solid at room temperature, or the curing type silicone is applied to the pipette tip in such a rate that the dry weight of the layer of the silicone formed on the pipette tip falls within the range of approximately 0.1 to 100 mg/tip, preferably within the range of 0.5 to 5 mg/tip. The solution of the silicone applied to the pipette tip is then dried.

As the silicone, which is solid at room temperature, or the curing type silicone, a polydiorganosiloxane should preferably be used which is linear or is partially crosslinked and which has the following repeating unit:

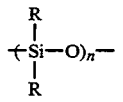

wherein R represents an alkyl group, an aryl group, an alkenyl group, or a monovalent group constituted of a combination of these groups, which groups may optionally have a functional group, such as a halogen atom, an amino group, a hydroxyl group, an alkoxy group, an aryloxy group, a (meth)acryloxy group, or a thiol group. Adhesion auxiliaries, such as a silane coupling agent or a titanate coupling agent, and photopolymerization initiators may be added to the polydiorganosiloxane.

As the raw material for the polymer (silicone rubber) having the aforesaid polysiloxane as the principal skeleton, a polysiloxane is used which has a molecular weight falling within the range of several thousands to several hundred thousands and which has a functional group at a terminal. The raw material is crosslinked and cured to form a silicone rubber in the manner described below. Specifically, the polysiloxane having the hydroxyl group at both terminals or at a single terminal is mixed with a silane crosslinking agent, which is represented by the general formula $$R_nSiX_{4-n}$$

wherein n represents an integer of 1 to 3, R represents one of the same substituents as those described above for R, and X represents a substituent selected from the group consisting of —OH, —$OR^2$,

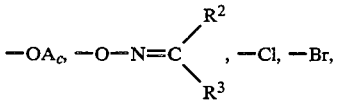

and —I, where $R^2$ and $R^3$ have the same meaning as that described above for R and may be identical with each other or different from each other, and Ac represents an acetyl group.

If necessary, an organic metal compound, such as an organotin compound, an inorganic acid, or an amine may be added as a catalyst to the resulting mixture of the polysiloxane and the silane crosslinking agent. Thereafter, the mixture thus obtained is heated or is subjected to the condensation cure at normal temperatures.

A silicone rubber layer can also be formed from the condensation cure of a mixture of the organopolysiloxane, which has a hydroxyl group at the terminal, and a hydrogen polysiloxane crosslinking agent. If necessary, a silane crosslinking agent may also be added to the mixture of the organopolysiloxane, which has a hydroxyl group at the terminal, and the hydrogen polysiloxane crosslinking agent.

Additionally, an addition type silicone rubber layer may be utilized, which is obtained from the process wherein a

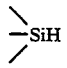

group and a —CH=$CH_2$ group are subjected to an addition reaction and crosslinked. The addition type silicone rubber layer is advantageous in that it is not adversely affected by humidity during the curing and can be crosslinked quickly, and in that predetermined physical properties can be obtained easily.

Specifically, the addition type silicone rubber layer is obtained from the reaction of a polyvalent hydrogen organopolysiloxane with a polysiloxane compound having two or more —CH=$CH_2$ bonds per molecule. The addition type silicone rubber layer should preferably be obtained from the curing and crosslinking of a composition consisting of the following constituents:

| | |
|---|---|
| (1) An organopolysiloxane having at least two alkenyl groups (preferably, vinyl groups), which are directly bonded to silicon atoms, per molecule | . . . 100 parts by weight |
| (2) A hydrogen organopolysiloxane having at least two SiH bonds per molecule | . . . 0.1 to 100 parts by weight |
| (3) An addition catalyst | . . . 0.00001 to 10 parts by weight |

In the constituent (1), the alkenyl groups may be located at the terminals or the middle parts of the molecular chain. Organic groups, for example, substituted or unsubstituted alkyl groups, and substituted or unsubstituted aryl groups, may also be present in the molecule of the constituent (1). The constituent (1) may also contain a small number of hydroxyl groups.

The constituent (2) reacts with the constituent (1) and forms a silicone rubber layer. In the constituent (2), the hydrogen group may be located at the terminal or the middle part of the molecule. Organic groups, for example, substituted or unsubstituted alkyl groups, and substituted or unsubstituted aryl groups, may also be present in the molecule of the constituent (2).

In order that good water repellency may be obtained, in each of the constituents (1) and (2), at least 60% of the number of the organic groups should preferably be constituted of methyl groups. The constituents (1) and (2) may have linear, cyclic, or branched molecular structures. For the sake of physical properties of rubber, the constituent (1) and/or the constituent (2) should preferably have a molecular weight higher than 1,000. Also, the molecular weight of the constituent (1) should more preferably be higher than 1,000.

By way of example, the constituent (1) may be an α,ω-bis-vinyldimethylsilyl polydimethylsiloxane or an α,ω-(bistrimethylsilyl)poly(methylvinyl)(dimethyl)-siloxane copolymer. The constituent (2) may be, for example, an α,ω-bis-(dimethylhydrogensilyl)polydimethylsiloxane, an α,ω-bis-(trimethylsilyl)polymethylhydrogensiloxane, an α,ω-bis(trimethylsilyl)poly(methylhydrogen)(dimethyl)siloxane copolymer or a cyclic poly(methylhydrogen)siloxane.

Among the hydrogen organopolysiloxanes enumerated above, the poly(methylhydrogen)(dimethyl)siloxane copolymer having trimethylsilyl groups at both terminals should preferably be employed as the constituent (2). The poly(methylhydrogen)(dimethyl)siloxane copolymer is represented by the formula

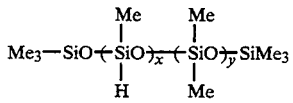

wherein x/y=100/0 to 10/90 (mol %).

By way of example, the poly(methylhydrogen)(dimethyl)siloxane copolymer may be the one represented by one of the formulas

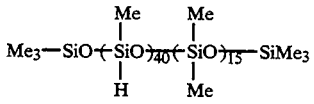

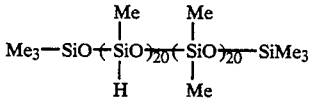

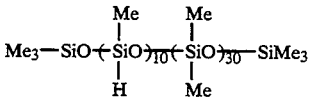

The addition catalyst as the constituent (3) may be selected from known catalysts. The addition catalyst should preferably be a platinum compound selected from the group consisting of, for example, platinum, platinum chloride, chloroplatinic acid, and an olefin-coordinated platinum.

In order to control the curing speed of the composition consisting of the constituents (1), (2), and (3), a crosslinking retarder may be added to the composition. The crosslinking retarder may be selected from the group consisting of organopolysiloxanes containing vinyl groups, such as tetracyclo(methylvinyl)siloxane; alcohols containing carbon-carbon triple bonds; acetone, methyl ethyl ketone; methanol; ethanol; and propylene glycol monomethyl ether.

The addition reaction occurs and the curing of the composition begins at the time at which the constituents (1), (2), and (3) are mixed together. The curing speed increases sharply as the reaction temperature becomes high. Therefore, in order that the pot life of the composition prior to the conversion into rubber can be kept long and the curing time required for the composition applied to the pipette tip to be kept short, the composition should preferably be kept at an appropriate, comparatively high temperature until the composition hardens to an appropriate level. The temperature, at which the composition is kept, is selected from a temperature range at which the pipette tip is not caused to deform. In such cases, good adhesion of the composition to the pipette tip can be obtained.

A known adhesion imparting agent, such as alkenyltrialkoxysilane, may be added to the composition. Also, a hydroxyl group-containing organopolysiloxane and a hydrolyzable functional group-containing silane (siloxane), which are usually employed during the formation of a condensation type silicone rubber layer, may be added to the composition. Additionally, a known filler, such as silica, may be added to the composition in order to improve the strength of rubber.

No limitation is imposed on the thickness of the silicone rubber layer, which is formed on the pipette tip in accordance with the present invention. However, it is at least necessary that a desired part of the outer circumferential surface of the pipette tip be covered uniformly with the silicone rubber layer.

Practically, the thickness of the silicone rubber layer, which is formed on the pipette tip in accordance with the present invention, should preferably fall within the range of 0.1 μm to 5 μm, more preferably within the range of 0.5 μm to 3 μm.

The amount of the silicone rubber layer per pipette tip depends on the size and the shape of the pipette tip. For a disposable type pipette tip, which takes up 10 μl to 100 μl of a liquid sample, the amount of the silicone rubber layer per pipette tip falls within the range of 0.1mg to 100mg. The amount of the silicone rubber layer per pipette tip should preferably fall within the range of 0.5mg to 50mg, and should more preferably fall within the range of 0.5mg to 10mg.

Even if the amount of the silicone rubber layer per pipette tip is larger than the aforesaid range, no particular problem will occur with regard to the performance of the pipette tip. However, in such cases, a longer time is required for the silicone rubber layer to be cured, and the treatment efficiency cannot be kept high. Also, the efficiency of utilization of the raw materials cannot be kept high.

The whole outer circumferential surface of the pipette tip in accordance with the present invention may be treated with the water repellent material. However, it is desirable that only the edge part of the pipette tip is treated with the water repellent material. In such cases, the treatment should be carried out on the part extending by a length, which falls within the range of 3mm to 15mm, from the leading edge of the pipette tip. The treatment should preferably be carried out on the part extending by a length, which falls within the range of 5mm to 15mm, from the leading edge of the pipette tip, more preferably on the part extending by a length, which falls within the range of 5mm to 7mm, from the leading edge of the pipette tip.

The treatment of the pipette tip with the water repellent material should be carried out such that the adhesion therebetween can be kept high. If the adhesion between the pipette tip and the water repellent material is low, problems will occur with regard to the processing. For example, the layer of the water repellent material will separate from the pipette tip due to mechanical friction.

An adhesive layer may be located between the outer circumferential surface of the pipette tip and the silicone rubber layer in order to improve the adhesion therebetween or to prevent the pipette tip from being attacked by the catalyst contained in the silicone rubber layer.

Silicone rubbers, which contain adhesion auxiliaries constituted of silane compounds, are also suitable for the purposes of the present invention. Examples of such adhesion auxiliaries are listed below.

1. 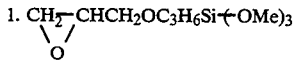

2. 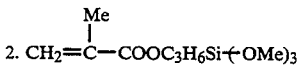

3. 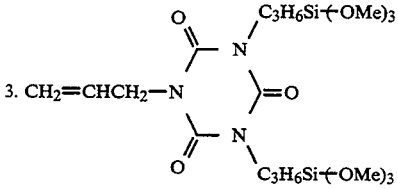

4. 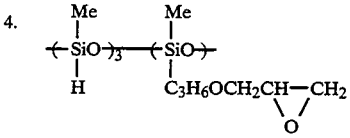

-continued

5. 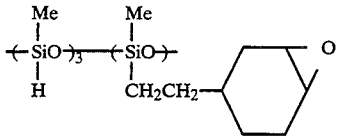

6. 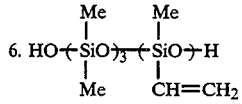

7. 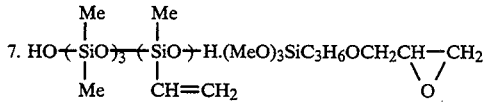

Reaction Product

8. $CH_2{=}CHSi(OC_2H_4OMe)_3$

9. $H_2NC_2H_4NHC_3H_6Si(OMe)_3$

10. $H_2NC_3H_6Si(OMe)_3$

11. 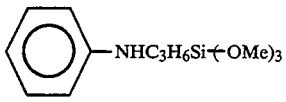

12. $ClC_3H_6Si(OMe)_3$

13. $OCNC_3H_6Si(OMe)_3$

14. 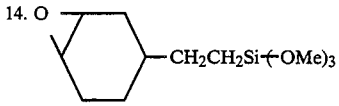

15. $(MeO)_3SiCH_2CH_2Si(OMe)_3$

The amount of the adhesion auxiliary added falls within the range of 1% by weight to 20% by weight, and should preferably fall within the range of 1% by weight to 5% by weight.

A primer or a reactive constituent may be used together with the silicone. Also, the liquid silicone, the solid silicone, and the curing type silicone may be used together in the form of a mixture.

In cases where the pipette tip is treated by being dipped in a silicone solution, the solution also enters the inner region of the pipette tip, and it often occurs that the opening of the pipette tip is closed by the silicone. In order for this problem to be eliminated, air should preferably be blown from the upper part of the pipette tip during the dipping or immediately after the pipette tip is taken out of the solution.

In cases where a fluorine resin is used as the water repellent material, the known spraying process may be employed.

The present invention will further be illustrated by the following nonlimitative examples.

EXAMPLES

Preparation of pipette tips treated with water repellent materials

Example 1

An outer circumferential surface of a disposable type polypropylene pipette tip (for 5 μl to 100 μl ), which was supplied by Eppendorf Co., Ltd., was wiped with a silicone sponge containing Toray Silicone SR2411. Toray Silicone SR2411 was used without being diluted. The pipette tip thus treated was left to stand at room temperature for 12 hours. In this manner, the silicone layer formed on the pipette tip was dried and cured. The length of the treated part was 8mm from the leading edge of the pipette tip. The dry weight of the silicone layer was 8 μg per pipette tip.

Example 2

A water repellent-treated pipette tip was prepared in the same manner as that in Example 1, except that, after the outer circumferential surface of the pipette tip was treated, the silicone layer thus formed was dried at 100° C. for three minutes.

Example 3

A water repellent-treated pipette tip was prepared in the same manner as that in Example 1, except that Toray Silicone SR2410 was used without being diluted and, after the outer circumferential surface of the pipette tip was treated, the silicone layer thus formed was dried at 100° C. for three minutes.

Examples 4 through 9

Pipette tips of the same type as that used in Example 1 were dipped in silicone compositions shown in Tables 1-1 and 1-2. In each case, the part extending by a length of 10mm from the leading edge of the pipette tip was dipped in the silicone composition and then taken out of the silicone composition. During the dipping process, slightly pressurized air was blown into the pipette tip and the bubbling was continued such that the composition did not enter the inner region of the pipette tip.

Thereafter, the silicone layers thus formed on the pipette tips were dried under the drying conditions listed in Table 1-1. The dry weight of each silicone layer was 4mg per pipette tip.

TABLE 1-1

| | Compositions and Drying Conditions | |
|---|---|---|
| | Composition | Drying condition |
| Example 1 | Toray Silicone SR2411 | At room temperature for 12 hours |
| Example 2 | Toray Silicone SR2411 | Heating at 100° for three minutes |
| Example 3 | Toray Silicone SR2410 | Heating at 100° for three minutes |
| Example 4 | Composition A | No heating |
| Example 5 | Composition A | Heating at 100° for three minutes |
| Example 6 | Composition B | No heating |
| Example 7 | Composition B | Heating at 100° for three minutes |
| Example 8 | Composition B | Leaving the composition to stand |
| Example 9 | Liquid silicone (viscosity at 20° C: 5,000 cP) | No heating |
| Example 10 | Fluorine resin | Heating at 100° for three minutes |
| Comp. Ex. 1 | No treatment | — |

TABLE 1-2

| | Composition | Composition A (g) | Composition B (g) |
|---|---|---|---|
| 1 | $CH_2{=}CH{-}(SiO)_{900}{-}Si{-}CH{=}CH_2$ (CH3 on each Si) | 9 | 9 |
| 2 | Platinum catalyst solution | 0.2 | 0.2 |
| 3 | $CH_3{-}Si{-}O{-}(SiO)_{30}{-}Si{-}CH_3$ (CH3 on Si, H on SiO) | 0.3 | — |
| 4 | $CH_3{-}Si{-}O{-}(SiO)_{10}{-}(SiO)_{20}{-}Si{-}CH_3$ (CH3 on Si, H on SiO, CH3 on SiO, CH3 on Si) | — | 1.0 |
| 5 | $CH_3{-}Si{-}O{-}(SiO)_{8000}{-}Si{-}CH_3$ (CH3 on Si, CH3 on SiO, CH3 on Si) | 2 | 2 |
| 6 | n-Hexane | 150 | 150 |

Example 10

A water repellent-treated pipette tip was prepared in the same manner as that in Example 2, except that a fluorine resin serving as a water repellent material was sprayed to the part extending by a length of approximately 10mm from the leading edge of a pipette tip of the same type as that in Example 1.

Evaluation

In each of Examples 1 to 10, 50 pipette tips treated with the water repellent material were prepared. Water, control blood serum (Monitrol I), human blood plasma, and human whole blood were used as liquid samples. Five pipette tips were used to take up and apply each liquid sample to a sample receiving surface. Evaluation was made as to how a droplet of each liquid sample was formed and whether the upward shifting phenomenon occurred or did not occur.

As Comparative Example 1, evaluation was also made for pipette tips which were not treated with a water repellent material.

Table 2 shows the results of the evaluation. In Table 2, marks have the meanings described below.

◎ : The results were acceptable in five applications of droplets.

○ : The results were acceptable in three or four applications of droplets.

Δ : The results were acceptable in one or two applications of droplets.

X : The results were not acceptable in five applications of droplets.

It was revealed that the pipette tips, which have been treated with a water repellent material in accordance with the present invention, have large effects particularly for liquid samples having a viscosity higher than the viscosity of water.

Example 11

The pipette tips prepared the same manner as that in Example 5 were left to stand at room temperature for two months. Thereafter, the evaluation was made in the same manner as that described above. Good results were obtained for all of the liquid samples, including the whole blood samples.

Example 12

Into a sample cup, 2ml of human blood plasma was taken up. A pipette tip prepared in the same manner as that in Example 7 was immersed into the human blood plasma, and sampling was carried out. Analyses were carried out with FDC-5000 supplied by Fuji Photo Film Co., Ltd. No adverse effects on the results of the analyses occurred for 22 items of analyses, including the whole blood.

TABLE 2

| | Results of Evaluation — Liquid sample | | | |
|---|---|---|---|---|
| | Water | Control blood serum | Human blood plasma | Human whole blood |
| Ex. 1 | ◎ | ○ | Δ | X |
| Ex. 2 | ◎ | ○ | Δ | X |
| Ex. 3 | ○ | Δ | X | X |
| Ex. 4 | ◎ | ◎ | ○ | Δ |
| Ex. 5 | ◎ | ◎ | ○ | Δ |
| Ex. 6 | ◎ | ◎ | ◎ | ◎ |
| Ex. 7 | ◎ | ◎ | ◎ | ◎ |
| Ex. 8 | ◎ | ◎ | ◎ | ◎ |
| Ex. 9 | ◎ | ◎ | ◎ | ◎ |
| Ex. 10 | ○ | Δ | Δ | X |
| Comp. Ex. 1 | ○ | X | X | X |

I claim:

1. A pipette tip obtained from molding of a plastic material, wherein at least part of the outer surface but not the inner surface of the pipette tip has been coated with a water-repellent material selected from the group consisting of silicone rubber to prevent a liquid droplet from clinging to the outer surface of the pipette tip.

2. The pipette tip of claim 1 wherein the coating has a thickness of from 0.1 to 5 μm.

* * * * *

UNITED STATES PATENT AND TRADEMARK OFFICE

CERTIFICATE OF CORRECTION

PATENT NO. : 5,336,468

DATED : August 9, 1994

INVENTOR(S) : Sigeru Tezuka, et al

It is certified that error appears in the above-identified patent and that said Letters Patent is hereby corrected as shown below:

Title Page (3rd inventor should read as follows)

[75] Inventors: Nobuyuki Kita

Signed and Sealed this

Eleventh Day of October, 1994

Bruce Lehman

*Attest:*

BRUCE LEHMAN

*Attesting Officer*

*Commissioner of Patents and Trademarks*